US010713863B2

(12) United States Patent
Jeon et al.

(10) Patent No.: US 10,713,863 B2
(45) Date of Patent: Jul. 14, 2020

(54) METHOD AND SYSTEM FOR PREDICTING DRIVING CONDITION OF VEHICLE

(71) Applicants: Hyundai Motor Company, Seoul (KR); Kia Motors Corp., Seoul (KR)

(72) Inventors: Byeong Wook Jeon, Seoul (KR); Kwang Hee Park, Suwon-si (KR); Jae Chang Kook, Hwaseong-si (KR); Sang Jun Park, Seoul (KR)

(73) Assignees: Hyundai Motor Company, Seoul (KR); Kia Motors Corp., Seoul (KR)

( * ) Notice: Subject to any disclaimer, the term of this patent is extended or adjusted under 35 U.S.C. 154(b) by 146 days.

(21) Appl. No.: 16/047,570

(22) Filed: Jul. 27, 2018

(65) Prior Publication Data

US 2019/0266813 A1 Aug. 29, 2019

(30) Foreign Application Priority Data

Feb. 27, 2018 (KR) ..... 10-2018-0023732

(51) Int. Cl.
*G07C 5/08* (2006.01)

(52) U.S. Cl.
CPC ..... *G07C 5/0808* (2013.01); *G07C 5/085* (2013.01)

(58) Field of Classification Search
CPC .... G07C 5/0808; G07C 5/085; G07C 5/0841; B60W 30/0956
USPC ..... 701/31
See application file for complete search history.

(56) References Cited

U.S. PATENT DOCUMENTS 5,152,192 A * 10/1992 Koenig ..... F16H 61/0213 477/120
6,166,449 A * 12/2000 Takaoka ..... B60K 6/26 290/40 B
9,193,357 B2 * 11/2015 Jeon ..... B60W 50/10
2011/0118929 A1 * 5/2011 Takae ..... B60W 50/16 701/31.4

FOREIGN PATENT DOCUMENTS

JP 4531876 B2 8/2010
KR 10-1526386 B1 6/2015
KR 10-1756717 B1 7/2017

* cited by examiner

*Primary Examiner* — Muhammad Shafi
(74) *Attorney, Agent, or Firm* — Morgan, Lewis & Bockius LLP

(57) ABSTRACT

A method of predicting a driving condition of a vehicle may include selecting a first prediction position where a vehicle is predicted to pass afterward while driving and predicting a first driving load of the vehicle at the first prediction position; when the vehicle reaches the first prediction position, measuring a driving condition of the vehicle at the first prediction position; and predicting a second driving load at a second prediction position where the vehicle is predicted to pass afterward by reflecting an error between the first driving load at the first prediction position and the real driving condition at the first prediction position.

20 Claims, 4 Drawing Sheets

METHOD AND SYSTEM FOR PREDICTING DRIVING CONDITION OF VEHICLE

CROSS REFERENCE TO RELATED APPLICATION

The present application claims priority to Korean Patent Application No. 10-2018-0023732, filed Feb. 27, 2018, the entire contents of which is incorporated herein for all purposes by this reference.

BACKGROUND OF THE INVENTION

Field of the Invention

The present invention relates generally to a method and system for predicting a driving condition of a vehicle. More particularly, the present invention relates to a method and system for predicting a driving condition of a vehicle, in which a driving load according to a road shape ahead of a vehicle is predicted and the predicted driving load is learned and compensated in real time.

Description of Related Art

Currently, shift control of an automatic transmission utilizes a current vehicle speed value and an accelerator pedal sensor (APS) value, in which a shift is performed by reflecting a current vehicle state and driver's intention. However, in the present automatic transmission control method, only the current vehicle state and the driver's intention are reflected, and thus predictive shift control according to a road shape such as a corner or ramp ahead of a vehicle is impossible.

To improve a shift performance of the automatic transmission, a method of predictively controlling a shift point in advance by recognizing the shape of a road ahead using a navigation system and by determining a driving load according to the road shape has been developed. In other words, a speed change gear is predicted according to curvature and grade of the road ahead using navigation information.

However, if accuracy of road information related to the navigation information, accuracy of grade information is not guaranteed, an accurate driving load determination may be impossible. Accordingly, an error occurs in determination of a required driving force for the driving load, causing an error to occur in speed change gear determination.

To overcome these problems, a high definition navigation system may be mounted in a vehicle, which results in a reduction of errors in the speed change gear determination, but causes a great increase in manufacturing cost. Thus, there is a demand for a method of predicting a driving load, which accurately predicts the driving load by use of a commercial navigation system, accurately and predictively controlling the transmission.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a method of predicting a driving condition of a vehicle, in which an error between a predicted driving load of a road ahead and a real driving load measured at a real position is used to compensate prediction for a driving load of a new road ahead, whereby prediction accuracy for the driving load is improved without provision of a high definition navigation system.

In various aspects of the present invention, there is provided a method of predicting a driving condition of a vehicle, the method including: selecting a first prediction position where a vehicle is predicted to pass afterward while driving and predicting a driving condition of the vehicle at the first prediction position; when the vehicle reaches the first prediction position, measuring a real driving condition of the vehicle at the first prediction position; and predicting a driving condition at a second prediction position where the vehicle is predicted to pass afterward by reflecting an error between the predicted driving condition at the first prediction position and the real driving condition at the first prediction position.

In the predicting the driving condition at the first prediction position, the predicted driving condition may be predicted using vehicle position information or road information at the first prediction position.

In the predicting the driving condition at the first prediction position, the predicted driving condition may be predicted using a predicted grade of the first prediction position.

The predicted driving condition may be predicted using the sum of aerodynamic drag of an entire body of the vehicle, rolling resistance between wheels of the vehicle and a road, and grade resistance according to the predicted grade.

In the measuring the real driving condition at the first prediction position, the real driving condition may be measured using vehicle speed information or vehicle acceleration information measured when the vehicle passes the first prediction position.

In the measuring the real driving condition at the first prediction position, a real grade of the first prediction position may be determined using the vehicle speed information or the vehicle acceleration information measured when the vehicle passes the first prediction position, and the real driving condition may be measured using the determined real grade.

The real driving condition may be predicted using the sum of aerodynamic drag of an entire body of the vehicle, rolling resistance between wheels of the vehicle and a road, and grade resistance according to a real grade.

In the predicting the driving condition at the second prediction position, the predicted driving condition may be predicted using road information at the second prediction position, and the predicted driving condition at the second prediction position may be corrected by determining a driving condition correction amount according to the error between the predicted driving condition at the first prediction position and the real driving condition at the first prediction position.

The driving condition correction amount may be determined to be proportional to the error between the predicted driving condition at the first prediction position and the real driving condition at the first prediction position.

The driving condition correction amount may be determined such that if magnitude of the error between the predicted driving condition at the first prediction position and the real driving condition at the first prediction position is equal to or less than a predetermined first reference value, the driving condition correction amount is determined using a predetermined minimum driving condition correction amount.

The driving condition correction amount may be determined such that if magnitude of the error between the predicted driving condition at the first prediction position and the real driving condition at the first prediction position is equal to or less than a predetermined second reference value, the driving condition correction amount is determined using a predetermined maximum driving condition correction amount.

The method may further include: after the predicting the driving condition at the second prediction position, determining a predicted required driving force or a predicted speed change gear at the second prediction position based on the predicted driving condition at the second prediction position; and predictively controlling a driving source or a transmission based on the determined predicted required driving force or the determined predicted speed change gear.

According to various aspects of the present invention, there is provided a system of predicting a driving condition of a vehicle, the system including: a sensor detecting vehicle drive information; a measuring device measuring a real driving condition of a vehicle at a first prediction position using the vehicle drive information detected by the sensor when the vehicle reaches the first prediction position; and a prediction device predicting a driving condition at the first prediction position where the vehicle is predicted to pass afterward while driving, and when the vehicle reaches the first prediction position, predicting a driving condition at a second prediction position where the vehicle is predicted to pass afterward by reflecting an error between the predicted driving condition at the first prediction position and the real driving condition at the first prediction position.

The system may further include: a memory in which road information at each of the first and second prediction positions is pre-stored, wherein the sensor may include a position detector configured for detecting vehicle position information, and the prediction device may predict the predicted driving condition using the vehicle position information detected by the position sensor or the road information at the first prediction position stored in the memory.

The prediction device may determine a predicted grade of the first prediction position according to the vehicle position information or the road information at the first prediction position and predict the predicted driving condition using the determined predicted grade.

The sensor may include a motion sensor measuring vehicle speed information or vehicle acceleration information, and the measuring device may measure the real driving condition using the vehicle speed information or the vehicle acceleration information measured by the motion sensor when the vehicle passes the first prediction position.

The measuring device may determine a real grade of the first prediction position using the vehicle speed information or the vehicle acceleration information, and measure the real driving condition using the determined real grade.

The prediction device may predict the predicted driving condition at the second prediction position, and correct the predicted driving condition at the second prediction position by determining a driving condition correction amount according to the error between the predicted driving condition at the first prediction position and the real driving condition at the first prediction position.

The system may further include: a driving source providing a driving force to wheels of the vehicle; and a driving controller determining a predicted required driving force at the second prediction position based on the predicted driving condition at the second prediction position, and predictively controlling the driving source based on the determined predicted required driving force.

The system may further include: a transmission transmitting a driving force provided by a driving source to wheels of the vehicle by increasing or decreasing the driving force; and a driving controller determining a predicted speed change gear at the second prediction position based on the predicted driving condition at the second prediction position, and predictively controlling the transmission based on the determined predicted speed change gear.

According to the method and system for predicting the vehicle driving condition according to the exemplary embodiments of the present invention, a predicted shape of a road ahead is corrected using a measured shape value, whereby it is possible to improve accuracy of transmission control according to a shape of a road ahead without provision of a high definition navigation system.

Furthermore, a shape of a road ahead is determined, whereby it is possible to enable accurate predictive shift control of the transmission according to the shape of the road ahead.

Moreover, due to the provided configuration, it is possible to reduce an unnecessary frequent shift, and to determine in advance a road condition ahead, thus facilitating a vehicle to be prepared for upcoming dangers.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
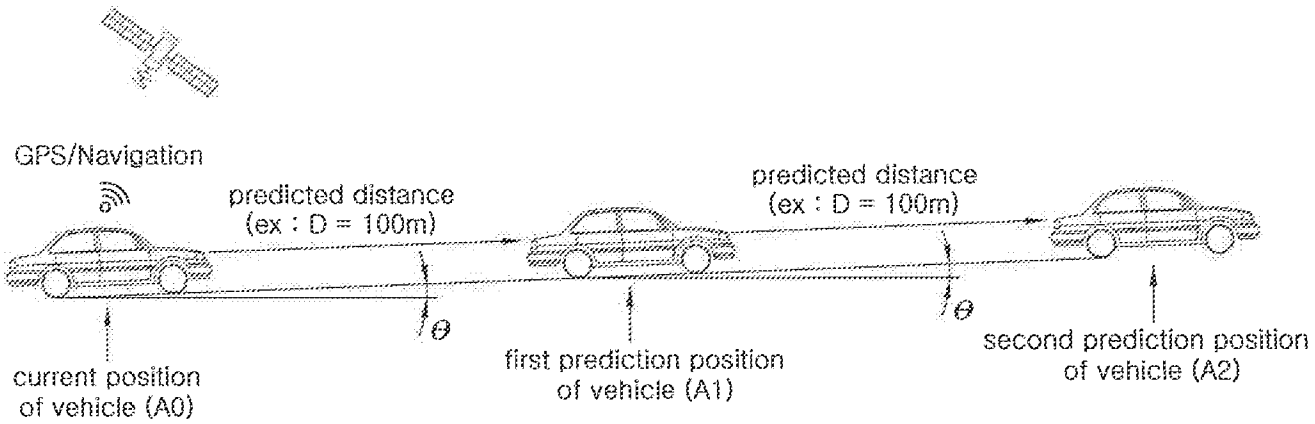
FIG. 1 is a view showing a relationship between a current position, a first prediction position, and a second prediction position in a method of predicting a driving condition of a vehicle according to an exemplary embodiment of the present invention.

It may be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the other hand, the invention(s) is/are intended to cover not only the exemplary embodiments, but also various alternatives, modifications, equivalents and other embodiments, which may be included within the spirit and scope of the invention as defined by the appended claims.

Specific structural and functional descriptions of embodiments of the present invention included herein are only for illustrative purposes of the exemplary embodiments of the present invention. The present invention may be embodied in various forms without departing from the spirit and significant characteristics of the present invention. Therefore, the exemplary embodiments of the present invention are included only for illustrative purposes and may not be construed as limiting the present invention.

Reference will now be made in detail to various embodiments of the present invention, specific examples of which are illustrated in the accompanying drawings and described below, since the exemplary embodiments of the present invention may be variously modified in various forms. While the present invention will be described in conjunction with exemplary embodiments thereof, it is to be understood that the present description is not intended to limit the present invention to those exemplary embodiments. On the other hand, the present invention is directed to cover not only the exemplary embodiments of the present invention, but also various alternatives, modifications, equivalents and other embodiments which may be included within the spirit and scope of the present invention as defined by the appended claims.

It will be understood that, although the terms "first", "second", etc. may be used herein to describe various elements, these elements should not be limited by these terms. These terms are only used to distinguish one element from another element. For instance, a first element discussed below could be termed a second element without departing from the teachings of the present invention. Similarly, the second element could also be termed the first element.

It will be understood that when an element is referred to as being "coupled" or "connected" to another element, it may be directly coupled or connected to the other element or intervening elements may be present therebetween. In contrast, it should be understood that when an element is referred to as being "directly coupled" or "directly connected" to another element, there are no intervening elements present. Other expressions that explain the relationship between elements, such as "between", "directly between", "adjacent to", or "directly adjacent to" should be construed in the same way.

The terminology used herein is for describing various exemplary embodiments only and is not intended to be limiting. As used herein, the singular forms "a", "an", and "the" are intended to include the plural forms as well, unless the context clearly indicates otherwise. It will be further understood that the terms "comprise", "include", "have", etc. when used in the present embodiment, specify the presence of stated features, integers, steps, operations, elements, components, and/or combinations thereof but do not preclude the presence or addition of one or more other features, integers, steps, operations, elements, components, and/or combinations thereof.

Unless otherwise defined, all terms including technical and scientific terms used herein have the same meaning as commonly understood by one of ordinary skill in the art to which the present invention belongs. It will be further understood that terms used herein should be interpreted as having a meaning which is consistent with their meaning in the context of the present specification and the relevant art and will not be interpreted in an idealized or overly formal sense unless expressly so defined herein.

Hereinbelow, various exemplary embodiments of the present invention will be described in detail with reference to the accompanying drawings. Throughout the drawings, the same reference numerals will refer to the same or like parts.

Figure 2:
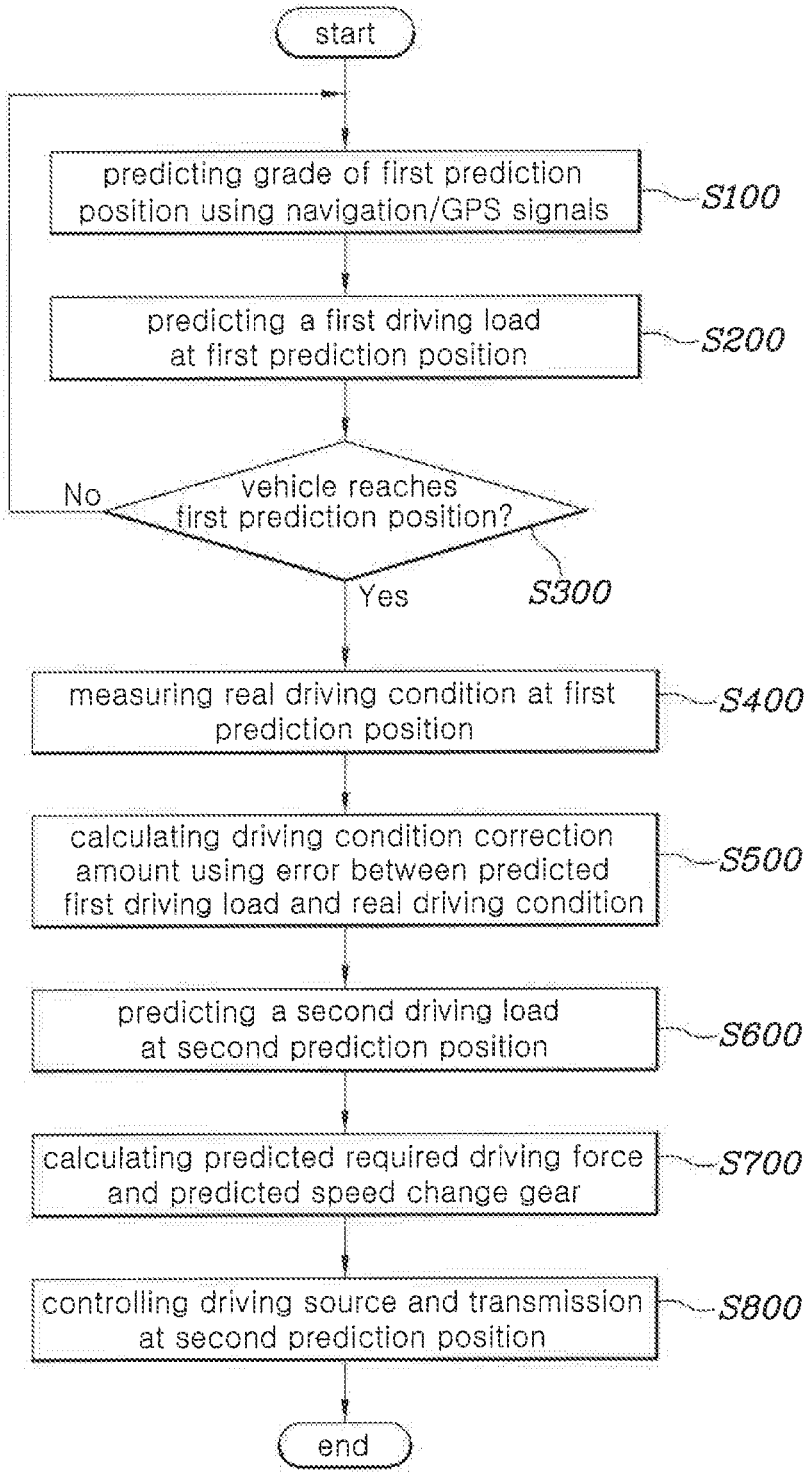
FIG. 2 is a flowchart showing the method of predicting the vehicle driving condition according to the exemplary embodiment of the present invention.

FIG. 1 is a view showing a relationship between a current position, a first prediction position, and a second prediction position in a method of predicting a driving condition of a vehicle according to an exemplary embodiment of the present invention, and FIG. 2 is a flowchart showing the method of predicting the vehicle driving condition according to the exemplary embodiment of the present invention.

Referring to FIG. 1 and FIG. 2, a method of predicting a driving condition of a vehicle according to an exemplary embodiment of the present invention may include: selecting a first prediction position A1 where a vehicle is predicted to pass afterward while driving and predicting a driving condition of the vehicle at the first prediction position A1 (S200); when the vehicle reaches the first prediction position A1 (S300), measuring a real driving condition of the vehicle at the first prediction position A1 (S400); and predicting a driving condition at a second prediction position A2 where the vehicle is predicted to pass afterward by reflecting an error between the predicted driving condition at the first prediction position A1 and the real driving condition at the first prediction position A1 (S500).

Herein, the driving condition denotes a concept including a driving load, which is a resistance that a vehicle receives from outside while driving, and may include all parameters related to drive of the vehicle, such as vehicle speed, grade, friction of the road surface, etc., which are applied from the inside or outside the vehicle.

As shown in FIG. 1, the first prediction position A1 may be a position where a vehicle is predicted to pass from a current position AO while driving. In other words, the first prediction position A1 may be a point positioned ahead of the current position AO of the vehicle by a predicted distance. In general, because the vehicle is assumed to advance, the predicted distance may be selected as a forward point, but it may be a point positioned sideward on a curve of a road, etc., or may be a point positioned rearward in the case of a reversing vehicle.

In the predicting the driving condition of the vehicle at the first prediction position A1 (S200), the predicted driving condition at the first prediction position A1 where a vehicle is predicted to pass afterward from the current position AO while driving may be predicted.

In detail, the predicted driving condition may be predicted using vehicle position information or road information at the first prediction position A1. In other words, the current position AO of the vehicle may be ascertained by receiving the vehicle position information through GPS, the first prediction position A1 positioned ahead by the predicted distance may be selected, and the predicted driving condition at the first prediction position A1 may be predicted by use of the road information at the first prediction position A1 such as grade θ and curvature of a road, etc. (S100).

The road information may use stored information related to a navigation system which is pre-stored in a memory, or may be received from outside in real time over wireless communication, etc. Alternatively, by use of a sensor mounted in a vehicle, information such as a traffic light ahead, a road sign, curvature and grade of a road ahead, etc. may be directly detected to ascertain the road information (S100).

In the predicting the driving condition at the first prediction position A1 (S200), the predicted driving condition may be predicted using a predicted grade $\theta_{Predict}$ of the first prediction position A1. The predicted driving condition may be predicted using a predicted driving load $RL_{Predict}$ (A1), which is determined using the sum of aerodynamic drag of an entire body of the vehicle, rolling resistance between wheels of the vehicle and a road, and grade resistance according to the predicted grade.

The predicted driving load $RL_{Predict}$(A1) may be determined using the sum of aerodynamic drag, rolling resistance, and grade resistance (slope resistance) as shown in the following equation.

$$RL_{Predict}(A1) = \frac{1}{2}C_d\rho AV^2 + \mu mg\cos\theta_{Predict} + mg\sin\theta_{Predict}$$

Herein, Cd is a drag coefficient of a vehicle, and is influenced by the shape and surface roughness of the vehicle. Accordingly, the drag coefficient is defined in consideration of influence of the aerodynamic shape of the vehicle. The drag coefficient may use a fixed value measured by conducting a wind tunnel test, or may use a variable value that varies depending on a change in wind inflow angle because the drag coefficient may vary depending on the change in wind inflow angle.

Furthermore, ρ is the air density that varies depending on pressure and temperature of air. A general fixed value (e.g., 1.22 [kg/m3]) may be used, or a variable value may be used because the pressure and temperature may vary depending on altitude above sea level.

Furthermore, A is the projected frontal area of a vehicle, which may be obtained by projecting a vehicle image on a vertical plane normal to the forward direction of drive. Furthermore, V may denote the vehicle speed. When determining the predicted driving load, vehicle speed at the current position AO may be used, or predicted vehicle speed at the first prediction position A1 may be used.

Furthermore, μ is the rolling friction coefficient, which may be determined by the tires and road surface. A fixed value provided by the tires may be used or a variable value that varies depending on the surface of a road ahead detected by a sensor may be used.

Furthermore, m is the mass of a vehicle. Furthermore, $\theta_{Predict}$ is the predicted grade, which is a value of the grade of the first prediction position A1, the value being predicted at the current position AO, and may be the stored information related to the navigation system which is pre-stored in the memory, or may be the road information received from outside in real time over wireless communication, etc., or may be a value detected by the sensor mounted in a vehicle.

In the measuring the real driving condition at the first prediction position A1 (S400), the real driving condition may be measured using vehicle speed information or vehicle acceleration information measured when a vehicle passes the first prediction position A1. An acceleration sensor or a speed sensor may be a longitudinal G-sensor, a G-sensor, a motion recognition sensor, etc.

In detail, when a vehicle reaches the first prediction position A1 (S300), a real grade $\theta_{Real}$ of the first prediction position A1 is determined using the vehicle speed information or the vehicle acceleration information measured when the vehicle passes the first prediction position A1, and the real driving condition may be measured using the determined real grade $\theta_{Real}$.

The real driving condition may be predicted using a real driving load $RL_{Real}$(A1), which is determined using the sum of aerodynamic drag of an entire body of the vehicle, rolling resistance between wheels of the vehicle and a road, and grade resistance according to the real grade. The real driving load $RL_{Real}$(A1) may be determined using the sum of the aerodynamic drag, the rolling resistance, and the grade resistance as shown in the follow equation:

$$RL_{Real}(A1) = \frac{1}{2}C_d\rho AV^2 + \mu mg\cos\theta_{Real} + mg\sin\theta_{Real}$$

A description of the same parts as the equation for determining the predicted driving load will be omitted.

Herein, V is vehicle speed measured when a vehicle passes the first prediction position A1. Furthermore, $\theta_{Real}$ is the real grade, which is a grade measured at the first prediction position A1.

In detail, the grade θ may be determined by the following equation.

$$\tan(\theta) * 100 = k * (G - dV) : \text{road grade}[\%]$$

$$k = \frac{1}{g\sqrt{1 - \sin^2\theta}}.$$

Herein, G is a measured value obtained by the longitudinal G-sensor and is the longitudinal acceleration of a vehicle. Furthermore, dV is change rate of speed of a vehicle, and may be a value obtained by differentiating the speed of the vehicle over time. Furthermore, g is the acceleration of gravity.

The grade θ determined using the above equation may be used as the real grade $\theta_{Real}$. Alternatively, a value measured by a sensor such as a gyro sensor, etc. while a vehicle passes the first prediction position A1 while driving may be used as the real grade $\theta_{Real}$.

In the predicting the driving condition at the second prediction position A2 (S600), the predicted driving condition may be predicted using road information at the second prediction position A2, and the predicted driving condition at the second prediction position A2 may be corrected by determining a driving condition correction amount according to the error between the predicted driving condition at the first prediction position A1 and the real driving condition at the first prediction position A1 (S500). In other words, the error between the predicted driving condition at the first prediction position A1 and the real driving condition at the first prediction position A1 is learned, and the resulting is reflected in prediction of the predicted driving condition at the second prediction position A2 where a vehicle passes afterward.

In the predicting the driving condition at the second prediction position A2 (S600), the predicted driving condition may be predicted using the road information at the second prediction position A2. When a vehicle passes the first prediction position A1 while driving, the second prediction position A2 where the vehicle is predicted to pass afterward may be selected. In detail, the second prediction position A2 may be selected to be a position ahead of the first prediction position A1 by the predicted distance, and the predicted driving condition at the second prediction position A2 may be predicted using current position information and the road information at the second prediction position A2.

The same method as that for predicting the driving condition at the first prediction position A1 may be applied to the predicted driving condition at the second prediction position A2. In other words, in the same way as predicting the predicted driving condition at the first prediction position A1, the predicted driving condition may be predicted using a predicted grade of the second prediction position A2.

Furthermore, the predicted driving condition at the second prediction position A2 may be corrected by determining the driving condition correction amount according to the error between the predicted driving condition at the first prediction position A1 and the real driving condition at the first prediction position A1.

The error between the predicted driving condition at the first prediction position A1 and the real driving condition at the first prediction position A1 may be caused by an error between the predicted grade and the real grade. In other words, an error between the rolling resistance and the grade resistance, which is caused by the error between the predicted grade and the real grade, may cause an error between the predicted driving load and the real driving load.

Furthermore, an error between vehicle speed at the first prediction position A1 which is predicted at the current position AO and real vehicle speed at the first prediction position A1 may cause an error in aerodynamic drag.

The vehicle speed at the first prediction position A1 which is predicted at the current position AO may be the vehicle speed at the current position AO or may be a value predicted as the vehicle speed at the first prediction position A1 using the road information. The predicted vehicle speed may be different from the real vehicle speed at the first prediction position A1, thus causing the error in aerodynamic drag.

Figure 3:
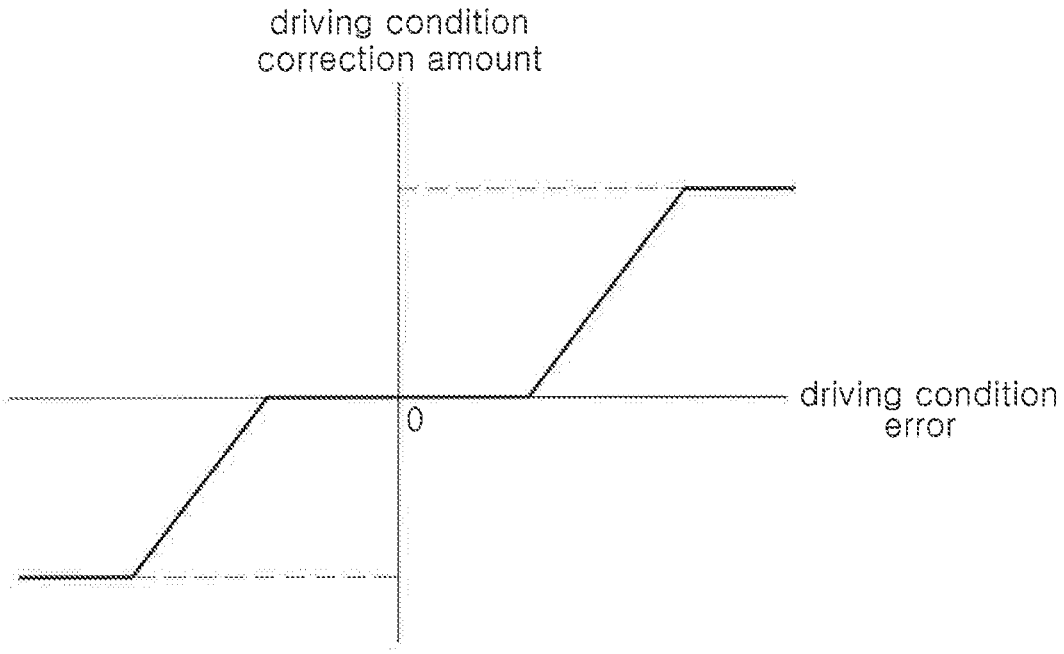
FIG. 3 is a graph showing a driving condition correction amount according to the exemplary embodiment of the present invention.

FIG. 3 is a graph showing a driving condition correction amount according to the exemplary embodiment of the present invention.

Referring to FIG. 3, the driving condition correction amount may be determined to be proportional to the error between the predicted driving condition at the first prediction position A1 and the real driving condition at the first prediction position A1. In other words, as magnitude of the error between the predicted driving condition at the first prediction position A1 and the real driving condition at the first prediction position A1 increases, the driving condition correction amount increases.

Furthermore, the driving condition correction amount may be determined such that if the magnitude of the error between the predicted driving condition at the first prediction position A1 and the real driving condition at the first prediction position A1 is equal to or less than a predetermined first reference value, the driving condition correction amount is determined using a predetermined minimum driving condition correction amount. The predetermined minimum driving condition correction amount may be zero. In other words, if the magnitude of the error between the predicted driving condition at the first prediction position A1 and the real driving condition at the first prediction position A1 is a very small level, it may be ignored, whereby errors caused by unnecessary control may be avoided.

Moreover, the driving condition correction amount may be determined such that if the magnitude of the error between the predicted driving condition at the first prediction position A1 and the real driving condition at the first prediction position A1 is equal to or less than a predetermined second reference value, the driving condition correction amount is determined using a predetermined maximum driving condition correction amount. According to whether the error is a positive or negative number, the predetermined maximum driving condition correction amount may be set individually or set to equal numerical values having opposite signs. If the magnitude of the error between the predicted driving condition at the first prediction position A1 and the real driving condition at the first prediction position A1 is very large, it is highly likely that real driving condition measuring resulted in an error. Thus, in the instant case, by avoiding excessive correction of the driving condition, control stability may be improved.

After the predicting the driving condition at the second prediction position A2 (S600), the method may further include: determining a predicted required driving force or a predicted speed change gear at the second prediction position A2 based on the predicted driving condition at the second prediction position A2 (S700); and predictively controlling a driving source or a transmission based on the determined predicted required driving force or the determined predicted speed change gear (S800).

In the determining the predicted required driving force or the predicted speed change gear at the second prediction position A2 (S700), a predicted required driving force at the second prediction position A2 may be determined using the predicted driving condition at the second prediction position A2. In other words, the driving load or vehicle speed, grade, friction of the road surface at the second prediction position A2, etc. is predicted, and thus the required driving force required at the second prediction position A2 is determined in advance, whereby the driving source may be controlled predictively. Herein, the driving source may include various driving sources such as an engine, a motor, a fuel cell, a battery, etc.

Furthermore, in the determining the predicted required driving force or the predicted speed change gear at the second prediction position A2 (S700), the predicted speed change gear at the second prediction position A2 may be determined using the predicted driving condition at the second prediction position A2.

In the predictively controlling the driving source or the transmission based on the determined predicted required driving force or the predicted speed change gear (S800), the driving load or vehicle speed, grade, friction of the road surface at the second prediction position A2, etc. is predicted, and thus an appropriate speed change gear is determined based on the vehicle speed, torque, etc. required at the second prediction position A2, whereby the transmission may be controlled predictively.

In detail, the predicted driving condition is set based on multiple reference values, in which each driving condition refers to a value range of from one reference value to an next reference value of the multiple reference values. When a certain condition is predicted, the predicted required driving force or the predicted speed change gear at the second prediction position A2 corresponding to the determined driving condition may be determined.

If the grade of a road ahead is equal to or greater than a predetermined level or if the curvature of the road ahead is equal to or greater than a predetermined level, the predicted speed change gear may be set to correspond thereto, and the predicted speed change gear may be set to decrease as the grade or curvature increases. Furthermore, because the driving load increases as the grade increases, the predicted speed change gear may be set to increase. In a case where a vehicle drives a downhill road, the predicted required driving force or the predicted speed change gear may be controlled in a reverse order with the former control.

In other words, there are cases, each case requiring a specific torque range among multiple stepwise torque ranges resulting from segmenting a full torque range of a vehicle at regular intervals, and the predicted driving force or the predicted speed change gear associated with a corresponding one of the cases may be predetermined and determined.

In the predicted required driving force and the predicted speed change gear at the second prediction position A2 which are previously determined, a point previous to the second prediction position A2 with a predetermined distance is set to a predictive control point. Accordingly, before a vehicle reaches the second prediction position A2, the driving source and the transmission may be controlled in advance by the predicted required driving force and the predicted speed change gear.

Figure 4:
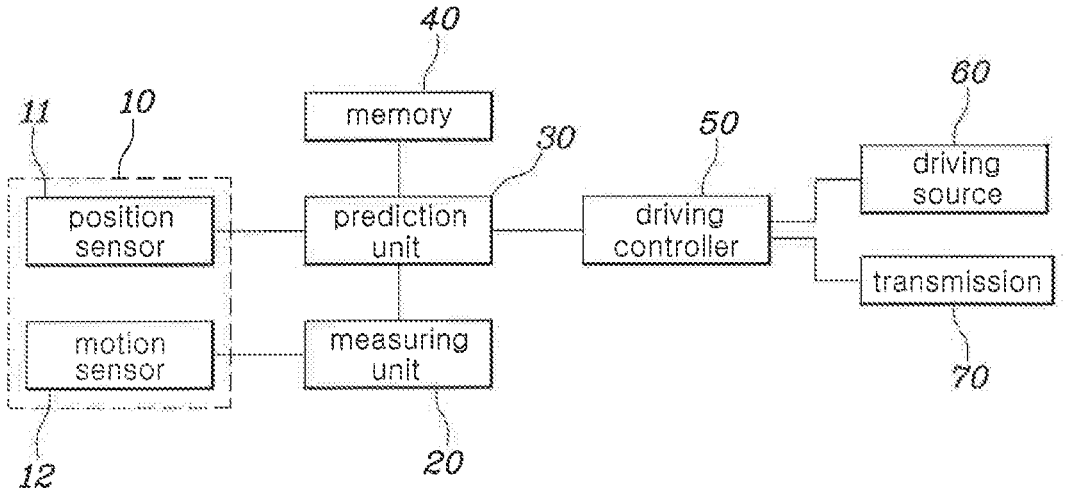
FIG. 4 is a configuration view showing a system for predicting a driving condition of a vehicle according to an exemplary embodiment of the present invention.

FIG. 4 is a configuration view showing a system for predicting a driving condition of a vehicle according to an exemplary embodiment of the present invention.

Referring to FIG. 4, the system for predicting the vehicle driving condition according to an exemplary embodiment of the present invention includes: a sensor 10 detecting vehicle drive information; a measuring device 20 measuring a real driving condition of a vehicle at a first prediction position A1 using the vehicle drive information detected by the sensor 10 when the vehicle reaches the first prediction position A1; and a prediction device 30 predicting a driving condition at the first prediction position A1 where the vehicle is predicted to pass afterward while driving, and when the vehicle reaches the first prediction position A1, predicting a driving condition at a second prediction position A2 where the vehicle is predicted to pass afterward by reflecting an error between the predicted driving condition at the first prediction position A1 and the real driving condition at the first prediction position A1.

The system for predicting the vehicle driving condition according to the exemplary embodiment of the present invention may further include a memory 40 in which road information at each of the first and second prediction positions is pre-stored, the sensor 10 may include a position sensor 11 detecting vehicle position information, and the prediction device 30 may predict the predicted driving condition using the vehicle position information detected by the position sensor 11 or the road information at the first prediction position A1 stored in the memory 40.

The prediction device 30 may determine a predicted grade of the first prediction position A1 according to the vehicle position information or the road information at the first prediction position A1 and predict the predicted driving condition using the determined predicted grade.

The sensor 10 may include a motion sensor measuring vehicle speed information or vehicle acceleration information related to a vehicle, and the measuring device 20 may measure the real driving condition using the vehicle speed information or the vehicle acceleration information measured by the motion sensor when the vehicle passes the first prediction position A1. The motion sensor may be an acceleration sensor, or may be a longitudinal G-sensor.

The measuring device 20 may determine a real grade of the first prediction position A1 using the vehicle speed information or the vehicle acceleration information, and measure the real driving condition using the determined real grade.

The prediction device 30 may predict the predicted driving condition at the second prediction position A2, and correct the predicted driving condition at the second prediction position A2 by determining a driving condition correction amount according to the error between the predicted driving condition at the first prediction position A1 and the real driving condition at the first prediction position A1.

The system may further include: a driving source 60 providing a driving force to wheels of a vehicle; and a driving controller 50 determining a predicted required driving force at the second prediction position A2 based on the predicted driving condition at the second prediction position A2, and predictively controlling the driving source 60 based on the determined predicted required driving force.

The system may further include: a transmission 70 transmitting a driving force provided by a driving source 60 to wheels of a vehicle by increasing or decreasing the driving force; and a driving controller 50 determining a predicted speed change gear at the second prediction position A2 based on the predicted driving condition at the second prediction position A2, and predictively controlling the transmission 70 based on the determined predicted speed change gear.

Figure 5A:
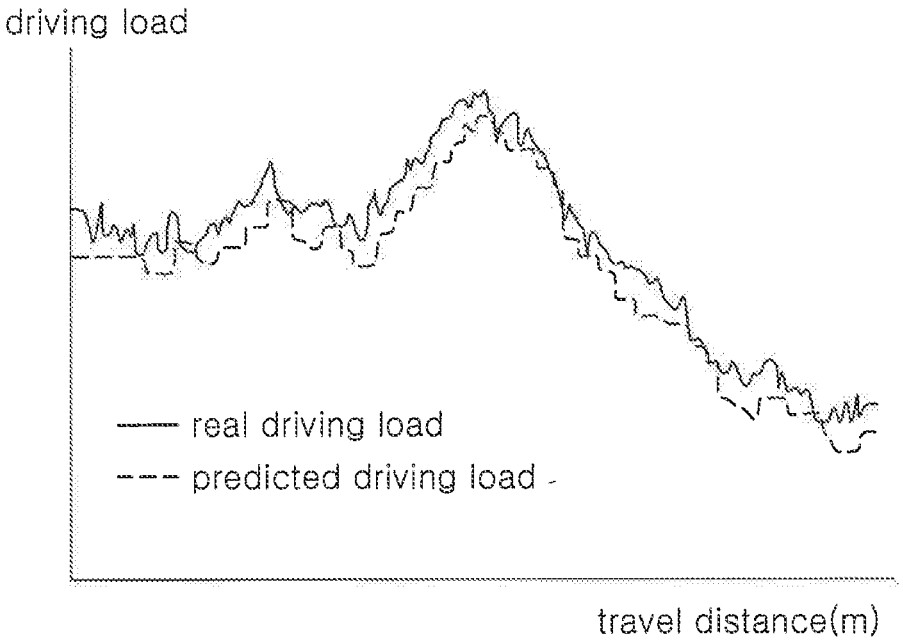
FIG. 5A and FIG. 5B are graphs each showing a predicted driving load and a real driving load before and after applying the method of predicting the vehicle driving condition according to the exemplary embodiment of the present invention.
Figure 5B:
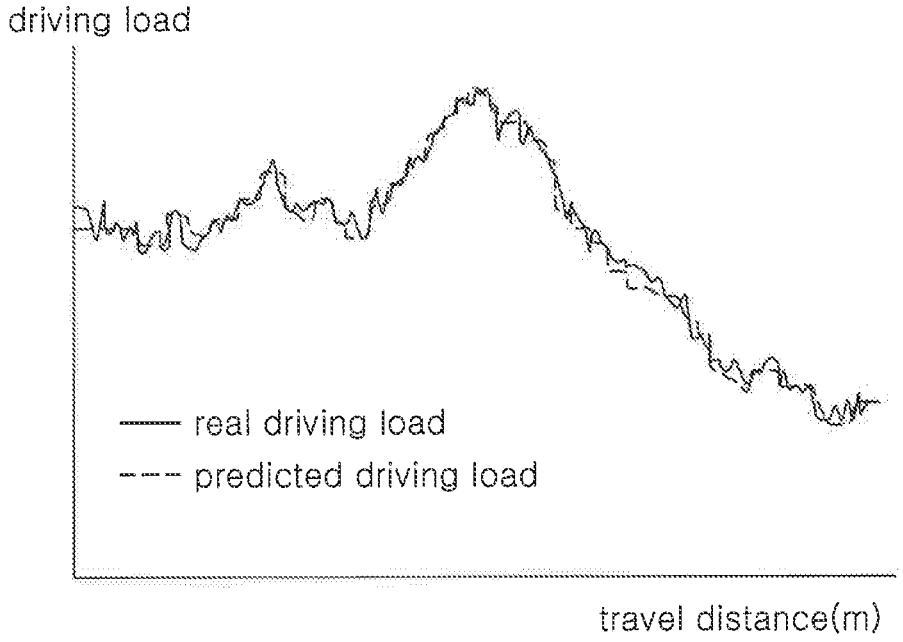

FIG. 5A and FIG. 5B are graphs each showing a predicted driving load and a real driving load before and after applying the method of predicting the vehicle driving condition according to the exemplary embodiment of the present invention.

As shown in FIG. 5A, it may be seen that before the method of predicting the vehicle driving condition according to the exemplary embodiment of the present invention is applied, there is an error between the predicted driving load and the real driving load, and such an error is not compensated so that there is a tendency that the error is maintained.

Referring to FIG. 5B in which the method of predicting the vehicle driving condition according to the exemplary embodiment of the present invention is applied, it may be seen that there is an error between the predicted driving load and the real driving load in the early stage, whereas as a drive distance increases as a vehicle drives, the error between the predicted driving load and the real driving load is learned and compensated, so that there is a tendency that the predicted driving load and the real driving load almost correspond to each other.

Thus, by applying the method of predicting the vehicle driving condition according to the exemplary embodiment of the present invention, the error between the predicted driving load and the real driving load may be learned and compensated as a vehicle drives, whereby it is possible to accurately predict the predicted driving load. Furthermore, the driving source and the transmission may be controlled predictively according to the accurately predicted driving load, whereby it is possible to optimally prepare for predictive driving of a vehicle.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A method of predicting a driving condition of a vehicle, the method comprising:

selecting a first prediction position where the vehicle is predicted to pass afterward while driving and predicting a driving load of the vehicle at the first prediction position;

when the vehicle reaches the first prediction position, measuring a driving load of the vehicle at the first prediction position; and predicting a driving load at a second prediction position where the vehicle is predicted to pass afterward by considering an error between the predicted driving load at the first prediction position and the measured driving load at the first prediction position.

2. The method of claim 1, wherein, in the predicting the driving load at the first prediction position, the predicted driving load at the first prediction position is determined using vehicle position information or road information at the first prediction position.

3. The method of claim 1, wherein, in the predicting the driving load at the first prediction position, the predicted driving load at the first prediction position is determined using a predicted grade of the first prediction position.

4. The method of claim 3, wherein the predicted driving load at the first prediction position is determined using a sum of aerodynamic drag of an entire body of the vehicle, rolling resistance between wheels of the vehicle and a road, and grade resistance according to the predicted grade of the first prediction position.

5. The method of claim 1, wherein, in the measuring the driving load at the first prediction position, the measured driving load at the first prediction position is determined using vehicle speed information or vehicle acceleration information measured when the vehicle passes the first prediction position.

6. The method of claim 5, wherein, in the measuring the driving load at the first prediction position, a real grade of the first prediction position is determined using the vehicle speed information or the vehicle acceleration information measured when the vehicle passes the first prediction position, and the measured driving load is determined using the determined real grade.

7. The method of claim 5, wherein the measured driving load is determined using a sum of aerodynamic drag of an entire body of the vehicle, rolling resistance between wheels of the vehicle and a road, and grade resistance according to a real grade.

8. The method of claim 1, wherein, in the predicting the driving load at the second prediction position, the predicted driving load at the second prediction position is determined using road information at the second prediction position, and the predicted driving load at the second prediction position is corrected by determining a driving condition correction amount according to the error between the predicted driving load at the first prediction position and the measured driving load at the first prediction position.

9. The method of claim 8, wherein the driving condition correction amount is determined to be proportional to the error between the predicted driving load at the first prediction position and the measured driving load at the first prediction position.

10. The method of claim 8, wherein the driving condition correction amount is determined such that when a magnitude of the error between the first predicted driving load at the first prediction position and the measured driving load at the prediction position is equal to or less than a predetermined first reference value, the driving condition correction amount is determined using a predetermined minimum driving condition correction amount.

11. The method of claim 8, wherein the driving condition correction amount is determined such that when a magnitude of the error between the predicted driving load at the first prediction position and the measured driving load at the first prediction position is equal to or less than a predetermined second reference value, the driving condition correction amount is determined using a predetermined maximum driving condition correction amount.

12. The method of claim 1, wherein further including:

after the predicting the driving load at the second prediction position, determining a predicted required driving force or a predicted speed change gear at the second prediction position based on the predicted driving load at the second prediction position; and controlling a driving source or a transmission based on the determined predicted required driving force or the determined predicted speed change gear.

13. A system of predicting a driving condition of a vehicle, the system comprising:

a sensor detecting vehicle drive information;

a measuring device configured for measuring a driving load of the vehicle at a first prediction position using the vehicle drive information detected by the sensor when the vehicle reaches the first prediction position; and a prediction device predicting a driving load at the first prediction position where the vehicle is predicted to pass afterward while driving, and when the vehicle reaches the first prediction position, predicting a driving load at a second prediction position where the vehicle is predicted to pass afterward by considering an error between the predicted driving load at the first prediction position and the measured driving load at the first prediction position.

14. The system of claim 13, further including:

a memory in which road information at each of the first and second prediction positions is pre-stored, wherein the sensor includes a position detector configured for detecting vehicle position information, and wherein the prediction device is controlled to determine the predicted driving load using the vehicle position information detected by the position detector or the road information at the first prediction position stored in the memory.

15. The system of claim 14, wherein the prediction device is configured to determine a predicted grade of the first prediction position according to the vehicle position information or the road information at the first prediction position and determines the predicted driving load using the determined predicted grade.

16. The system of claim 13, wherein the sensor includes a motion sensor configured for measuring vehicle speed information or vehicle acceleration information, and the measuring device measures the driving load at the first prediction position, using the vehicle speed information or the vehicle acceleration information measured by the motion sensor when the vehicle passes the first prediction position.

17. The system of claim 16, wherein the measuring device is configured to determine a real grade of the first prediction position using the vehicle speed information or the vehicle acceleration information, and determines the measured driving load using the determined real grade.

18. The system of claim 13, wherein the prediction device is controlled to determine the predicted driving load at the second prediction position, and corrects the predicted driving load at the second prediction position by determining a driving condition correction amount according to the error between the predicted driving load at the first prediction position and the measured driving load at the first prediction position.

19. The system of claim 13, further including:

a driving source providing a driving force to wheels of the vehicle; and a driving controller configured for determining a predicted required driving force at the second prediction position based on the predicted driving load at the second prediction position, and controlling the driving source based on the determined predicted required driving force.

20. The system of claim 13, further including a transmission transmitting a driving force provided by a driving source to wheels of the vehicle by increasing or decreasing the driving force; and a driving controller configured for determining a predicted speed change gear at the second prediction position based on the predicted driving load at the second prediction position, and controlling the transmission based on the determined predicted speed change gear.

* * * * *